United States Patent [19]

Barron

[11] 4,248,036

[45] Feb. 3, 1981

[54] BULKY YARN

[75] Inventor: Eugene R. Barron, Wilmington, Del.

[73] Assignee: E. I. Du Pont de Nemours and Company, Wilmington, Del.

[21] Appl. No.: 18,527

[22] Filed: Mar. 8, 1979

[51] Int. Cl.[3] ..... D02G 3/34; D02J 1/08

[52] U.S. Cl. ..... 57/227; 28/271; 57/226; 57/244; 57/908

[58] Field of Search ..... 57/205, 207, 208, 210, 57/225, 226, 227, 228, 350, 243, 244, 245, 246, 283, 288, 290, 293, 908; 28/268, 271, 272, 281, 286

[56] References Cited

U.S. PATENT DOCUMENTS

| | | | |
|---|---|---|---|
| 2,852,906 | 9/1958 | Breen | 57/350 |
| 3,350,871 | 11/1967 | Pierce | 57/246 X |
| 3,365,872 | 11/1968 | Field | 57/224 |
| 3,433,008 | 3/1969 | Gage | 57/246 X |
| 3,447,302 | 6/1969 | Field | 57/227 X |
| 3,455,096 | 7/1969 | Whitley | 57/350 |
| 3,812,668 | 5/1974 | Wilson | 28/271 X |
| 3,971,202 | 7/1976 | Windley | 57/205 |

*Primary Examiner*—Donald Watkins

[57] ABSTRACT

A bulky continuous filament yarn, in which continuous filament core yarns of polymeric material are substantially straight and free from loops and comprise from about 65 to about 93 percent of the total filaments by weight while the remainder of the total filaments are continuous filament effect yarns having a denier per filament of up to 5.0 that are inserted between the filaments of the core yarn and protrude from the surface of the core yarn in a mixture of crunodal and arch-like loops, is made by feeding a larger denier yarn at low overfeed and a much smaller denier yarn at low to moderate overfeed through a jet supplied with ambient air.

6 Claims, 2 Drawing Figures

BULKY YARN

BACKGROUND OF THE INVENTION

The invention relates to the production of bulky continuous filament yarn and more particularly, it relates to air-jet-textured yarns known as core-and-effect yarns.

Among many types of continuous filament synthetic yarns which simulate the bulk and feeling of spun staple yarns, one of the more successful types is that which has been air-textured in a jet at an overfeed to loop and entangle the filaments, as disclosed in Breen U.S. Pat. No. 2,783,609. One version of such yarns is known as core-and-effect, wherein one or more yarns are fed to the texturing jet at a low degree of overfeed and one or more additional yarns are fed at a higher degree of overfeed so that the first or core yarn is untextured and supports the tension imposed on the fabric while the second or effect yarn forms the surface loops which contribute the spun-like character.

Prior art core-and-effect yarns are comprised of relatively low-denier core yarn to provide modest tensile strength and a relatively higher denier effect yarn to impart high bulk or some novel feature such as a boucle effect. The effect yarns constitute half or more of the total yarn denier. The effect yarn overfeed has usually been 70 percent or more to maximize bulk and texture. However, the relatively low breaking strength of prior art core-and-effect yarns makes them generally unattractive for most industrial end uses.

Such industrial end uses include the fabric reinforcement in fire hoses or V-belts, where high strength is the most important requirement and only a modest amount of texture is needed to improve the adhesion between the fabric and rubber. In other applications, the webbing straps and covering of knapsacks, for example, require high tenacity for strength with light weight. Texture is needed to prevent warp and weft yarns from shifting under high loads so that the knapsack will retain its proper shape. In apparel uses such as denim for work trousers, strength is the primary requirement and only a small amount of texture is needed to provide spun-like aesthetics and retain shape. Spun hand is desirable in most apparel end uses.

One type of yarn which has been used for such purposes has been made by passing high-tenacity, continuous filament nylon or polyester yarn through an air texturing jet at overfeeds of 7 to 43 percent as disclosed in Gage U.S. Pat. No. 3,433,008. Since each filament of such yarns forms crunodal loops, the load bearing strength depends on the tightness of entanglement of the filaments and the frictional forces between filaments, which govern the load at which the filaments begin to slide past each other and the crunodal loops begin to disappear.

Lower yarn initial modulus and higher yarn breaking elongation, irreversible bulk losses when yarns are subjected to loads, and proportionately lower yarn breaking strengths (vs. component feed yarn) are a direct consequence of this phenomenon. Optimum selection of yarn finish is critical since high finish levels and high lubricity finishes generally reduce yarn bulk stability. The Gage patent requires a special high friction finish which may not be optimum for best operability in fabric-making processes.

Breaking strength of the textured yarn is seldom greater than 60 percent of the breaking strength of the component yarn and often as low as 45 percent.

It has now been found that yarns with both high tenacity and spun-like hand may be made by core-and-effect texturing using a particular selection of untextured supply yarns and texturing conditions.

These yarns overcome many of the negative features associated with single- and parallel-end air textured yarns. Specifically, yarns of this invention generally have breaking strengths 80 percent to 90 percent of the component core yarn; bulk stability is insensitive to yarn finish; and bulked yarns have higher initial moduli and lower breaking elongations than corresponding parallel air textured yarns. These yarns do not lose their texture until the core yarn reaches its breaking point.

SUMMARY OF THE INVENTION

A method for producing a bulky continuous filament yarn in which continuous filament core yarns of polymeric material comprising from about 65 to about 93 percent of the total filaments by weight are substantially straight and free from loops and the remainder of the total filaments being continuous filament effect yarns having a denier per filament of up to 5.0 which are inserted between the filaments of the core yarn and protrude from the surface of the core yarn in a mixture of crunodal and arch-like loops, the method comprising (a) pretreating the core yarn by application of water;
(b) feeding the core yarn to a texturing jet at an overfeed of about 1.5 to about 7.0 percent;
(c) while simultaneously feeding the effect yarn to said jet at an overfeed of about 20 to about 60 percent;
(d) combining said core and effect yarns in a turbulent flow of air at ambient temperature in said jet; and
(e) tensioning said combined core and effect yarn while winding it on a package.

DETAILED DESCRIPTION OF THE ILLUSTRATED EMBODIMENT

Figure 1:
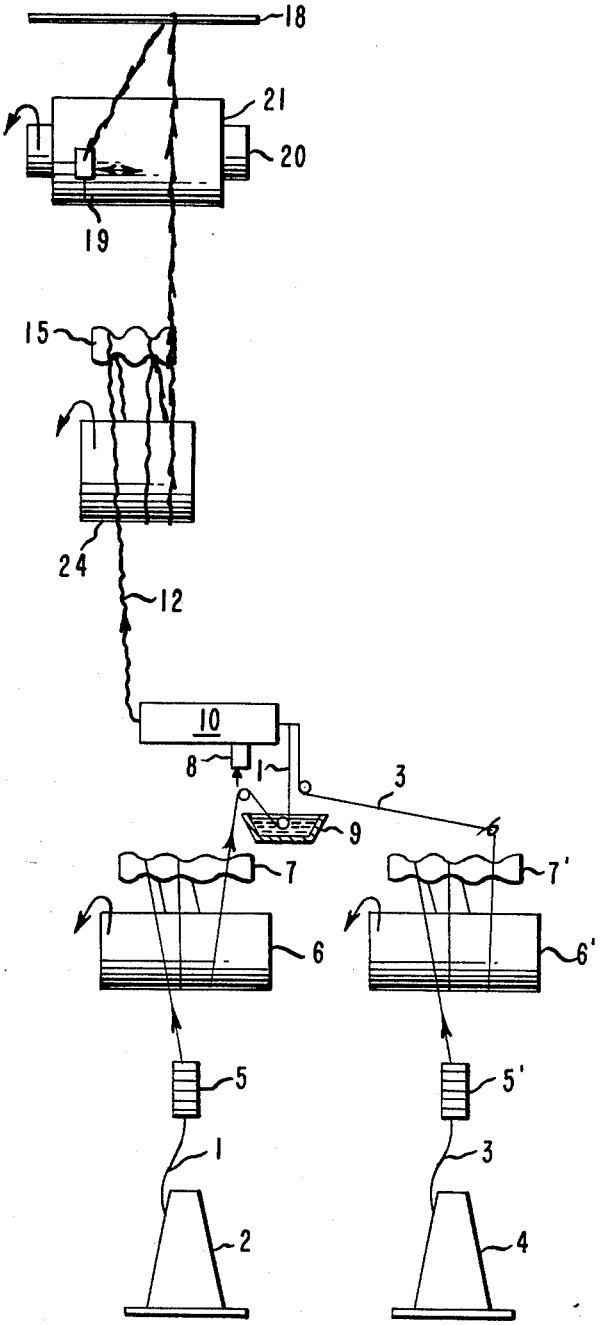
FIG. 1 is a schematic representation of apparatus useful for making yarns of the invention.

FIG. 1 shows schematically a method of making yarns of the invention. An untextured core yarn 1 is taken from package 2 and passes through tension and stop motion device 5 to feed roll 6 where it may be wrapped several times with guide 7 to prevent slippage. It then passes through a water tank 9 wherein yarn is wetted before it enters texturing jet 10 which is supplied with compressed air through pipe 8 from a source not shown. An untextured effect yarn 3 is taken from package 4 through tension and stop motion device 5' to feed roll 6' and guide 7' to texturing jet 10. Textured yarn 12 emerging from texturing jet 10 contacts intermediate roll 24 operating at a surface speed less than that of feed rolls 6 and 6'. Multiple wraps to reduce slippage may be provided by grooved guides 15 or equivalent means. Yarn 12 then passes over one or more guides 18 to traverse guide 19 of a windup which winds yarn 12 at desired tension on core 20 to form yarn package 21.

Intermediate core yarn overfeed is a measure of the speed differential between feed roll 6 and intermediate roll 24 and is calculated from the formula $ICOF=100[V_6-V_{24})/V_{24}]$ where ICOF=intermediate core overfeed expressed in percent, $V_6$=surface speed of feed roll 6 expressed in ypm, and $V_{24}$=surface speed of intermediate roll 24 expressed in ypm.

Intermediate overfeed determines the freedom which the core filaments have to open and permit the effect filaments to be inserted and anchored between those of the core. Too low an overfeed does not permit the effect to enter. Too high an overfeed may entangle and loop the core filaments, lowering the core tenacity. For the process of the present invention, intermediate core overfeeds are about 2.5 percent to about 8 to 9 percent. The upper limit depends somewhat on the desired product properties. In general, the lowest intermediate core overfeed which gives adequate consolidation of the effect yarn is preferred.

After texturing, the core yarn must be tensioned to remove any loops of the core filaments and to distribute tensile loading as equally as possible on all filaments to give maximum load-bearing capability. Such tensioning is most commonly applied by the windup running slightly faster than the intermediate roll 24, in which case the winding tension both forms the package and stabilizes the yarn. If this tensioning is inadequate, an additional driven roll may be used to apply the desired tension.

The effect yarn overfeed as measured to the windup correlates approximately with the differential length between core and effect filaments as described below under the heading "Determination of Effect Yarn Overfeed From Yarn."

Core overfeed is a measure of the speed differential between the feed roll 6 and wind-up 21 and is calculated from the formula $COF=100[(V_6-V_{21})/V_{21}]$ where COF=core overfeed expressed in percent, $V_6$ is surface speed of feed roll 6, and $V_{21}$ is surface speed of wind-up 21.

Core overfeed should be between about 1.5 percent and about 7 percent, most preferably 2.5 to 5 percent. Overfeed stated in the Examples and claims are calculated in this manner unless otherwise specified.

The effect overfeed is calculated exactly as the core overfeed except speed of feed roll $V_6'$ is substituted for $V_6$.

The effect overfeed is from about 20 percent to about 60 percent, most preferably 30 to 55 percent.

Overfeed in the higher end of this range may be used when a relatively lower denier effect yarn is employed so that there is a larger percentage of effect yarn to impart the desired spun-like aesthetics. Conversely, overfeeds in the lower end of this range may be used when a relatively higher denier effect yarn is employed to compensate for the larger amount of effect yarn.

At high effect overfeeds, the bulkiness of the yarn is likely to vary along the length. Such variation can be at least partially minimized by increasing the texturing jet air pressure, increasing the core yarn overfeed, or reducing the yarn speed through the texturing jet.

The core/effect ratio is a convenient indication of utility in yarns of the invention. Conventional core and effect textured yarns have C/E ratios of 0.5 or less. In yarns of the present invention, the C/E ratio indicates what proportion of the total yarn is available to carry tensile load, a high ratio such as 0.8 or more being desired for web straps and fire hose reinforcement while lower ratios down to 0.65 can be used for apparel or upholstery where surface character or bulk are more important.

DETERMINATION OF CORE/EFFECT RATIO

Core/Effect Ratio is calculated from the following formula: $C/E=[(100+COF)(D_C)/D_T]/[(100+EOF)(D_E)/D_T]$ where COF is the core yarn overfeed expressed in percent, $D_C$ is the base denier of the core yarn, $D_T$ is the denier of the textured yarn 21, EOF is the effect yarn overfeed expressed in percent, and $D_E$ is the base denier of the effect yarn.

DETERMINATION OF EFFECT YARN OVERFEED FROM YARN

When it is desired to determine the overfeed at which a yarn sample has been made, a section of yarn of some convenient length, say two cm, is clipped from the yarn. Filaments of the effect yarn are then extracted from the sample, one end of each filament being anchored and the filaments are straightened and their lengths measured. The approximate overfeed in percent is then calculated as follows:

$$\text{overfeed} = \left(\frac{\text{extended length} - \text{sample length}}{\text{sample length}}\right) \times 100.$$

If the bulkiness of the yarn sample varies along the length, the sample length should be made sufficiently long to include both sections of maximum and minimum bulkiness.

Figure 2:
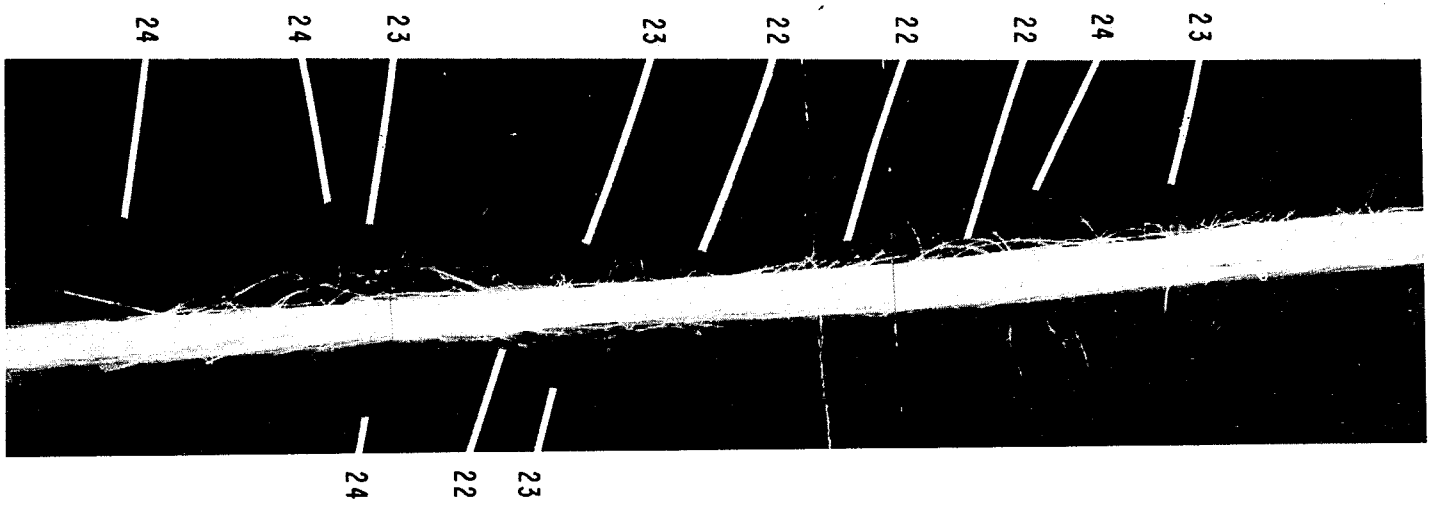
FIG. 2 is a representative magnified view of a yarn of the invention.

Referring to FIG. 2, a yarn of this invention typically has crunodal loops 23 and arch-like loops 22 and 24 formed from the filaments of the effect yarn which protrude from the surface of core yarn 1. Crunodal loops 23 depart from and return to the core yarn at substantially the same point along the length of the core. There are also a number of short arch-like loops 22 which are anchored into the core at very short distances along the length. Such loops may be as effective as crunodal loops in preventing shifting of yarns in fabric. The long arch-like loops 24 which are anchored at longer distances give most of the spun-like aesthetics to the product and are desirable as long as their number and distance between anchoring points does not become excessive. The majority of the effect filament loops, including the long arch-like loops, have a free length along the length of the yarn of less than about 4 mm.

The combination of arch-like and crunodal loops is particularly useful in products where both fabric stability and spun-like hand are desired. Crunodal loops may be most effective in stabilizing a fabric, preventing warp and filling yarns from slipping under high loading. Arch-like loops most closely simulate the soft feel of staple yarns, whereas crunodal loops give a harsher feeling. In the present yarns, the arch-like loops generally project farther from the core yarn surface than the crunodal loops, giving predominantly soft spun-like feel.

Core yarns are preferably high strength, high modulus materials such as nylon and polyester filament types commonly used for tire cord and other industrial uses. Such yarns have a tenacity of 5.5 grams per denier or more.

Effect yarns may be of any material suitable to give the desired visual and tactile aesthetics and may be such materials as acetate, rayon or other. However, in fabrics where maximum strength, stability, rubber adhesion or wear resistance are important, the effect yarns should be tough fibers such as nylon or polyester. Such the effect yarn is only a small proportion of the total product, high-cost materials may occasionally be justified if they can contribute unique advantages. The small size of effect yarn filaments favors small crunodal loops because of the low forces required to bend such filaments. The small filament size also gives softer aesthetics than prior yarns where the surface loops were formed from higher denier filaments or yarns chosen primarily for high strength and high modulus, since such yarns had to contribute both the load-bearing and the texture-giving functions. The denier per filament of present effect yarns should preferably be 5 or less.

EXAMPLES

Yarns of the following examples were processed on an Eltex Type AT texturing machine equipped with Taslan® jets of Lubach U.S. Pat. No. 3,545,057 having yarn needles with yarn passage minimum diameters 0.040 inch (1.02 mm) and a flange air orifice 0.078 inch (1.98 mm), and an exit venturi having a minimum diameter of 0.078 inches (1.98 mm). The process was generally as shown in FIG. 1.

The core yarn was processed wet and the effect yarn dry. Process conditions are shown in Table I.

TABLE I

| Example | I | II | III | IV | V | VI | VII |
|---|---|---|---|---|---|---|---|
| Core Yarn Denier | 1000 | 1000 | 840 | 1260 | 840 | 840 | 840 |
| dtex | 1111 | 1111 | 932 | 1400 | 932 | 932 | 932 |
| No. fils. | 192 | 192 | 140 | 210 | 140 | 140 | 140 |
| Mat'l. | polyester | polyester | 66 nylon | 66 nylon | 66 nylon | 66 nylon | 66 nylon |
| Effect Yarn Denier | 70 | 70 | 70 | 70 | 150 | 150 | 300 |
| dtex | 78 | 78 | 78 | 78 | 167 | 167 | 334 |
| No. fils. | 34 | 34 | 34 | 34 | 34 | 68 | 136 |
| Mat'l. | polyester | polyester | 66 nylon | 66 nylon | polyester | polyester | polyester |
| Jet Air Pressure PSI | 100 | 90 | 100 | 100 | 100 | 100 | 100 |
| (kPa) | 690 | 620 | 690 | 690 | 690 | 690 | 690 |
| Rolls Speeds ypm | | | | | | | |
| core | 309 | 113 | 307 | 326 | 326 | 326 | 326 |
| effect | 404 | 173 | 398 | 475 | 421 | 421 | 421 |
| intermediate | 297 | 110 | 292 | 302 | 303 | 303 | 303 |
| windup | 301 | 111 | 295 | 314 | 312 | 312 | 312 |
| % Overfeed (1) Core | 4.0 | 2.7 | 5.1 | 7.9 | 7.6 | 7.6 | 7.6 |
| % Overfeed (2)-Core | 2.7 | 1.8 | 4.1 | 3.8 | 4.5 | 4.5 | 4.5 |
| Effect | 34 | 56 | 35 | 51 | 35 | 35 | 35 |
| Windup Tension, gm | 75 | 90–95 | 65 | 85 | 90 | 90 | 90 |
| Bulked Yarn Denier | 1121 | 1127 | 965 | 1402 | 1057 | 1058 | 1254 |
| dtex | 1248 | 1251 | 1072 | 1560 | 1173 | 1174 | 1392 |
| Core/Effect Ratio | 92/8 | 90/10 | 90/10 | 93/7 | 81/19 | 81/19 | 68/32 |
| Breaking Strength (BS) | | | | | | | |
| Total (T) BS (lbs) | 15.4 | 14.7 | 16.5 | 23.1 | 15.4 | 15.0 | 16.1 |
| Core (C) BS (lbs) | 18.8 | 18.8 | 18.3 | 27.7 | 18.3 | 18.3 | 18.3 |
| % T/C | 82 | 78 | 90 | 83 | 84 | 82 | 88 |

(1) Feed roll to intermediate roll (ICOF)
(2) Feed roll to windup (COF)

EXAMPLE I

A core yarn of 1000 denier (1111 dtex) 192 filament polyester is overfed at 2.7 percent and joined in a texturing jet with an effect yarn of 70 denier (78 dtex), 34 filament polyester overfed at 34 percent. The effect yarn is well consolidated with the core yarn and has a mixture of crunodal and arch-like loops. It is woven to form a 27×24 greige count plain weave fabric with the yarn in both warp and filling. The fabric is jig-dyed with 3 percent Eastman F Blue BGLF and heat set at 360° F. The effect yarn dyes to a slightly darker shade than the core, giving a slightly mottled tone-on-tone appearance like that of fabric from spun yarn. However, this fabric has high strength attributable to the high tenacity of the core yarn yet the surface loops of the effect yarn give a spun-like feel.

EXAMPLE II

The same yarns as in Example I are textured at a core overfeed of 1.8 percent and an effect overfeed of 56 percent. FIG. 2 represents this yarn. This yarn has a desirable balance of bulk and strength.

EXAMPLE III

A core yarn of 840 denier (932 dtex), 140 filaments, 66 nylon is overfed at 4.1 percent to a texturing jet and joined with a 70 denier (78 dtex), 34 filament, 66 nylon overfed at 35 percent. The effect yarn is well consolidated with the core. It is woven to form a 32×32 greige count plain weave fabric with the yarn in both warp and filling. The fabric has high strength, good stability, spun-like hand and softer tactile aesthetics than are usually obtained with Taslan®, where the surface loops are primarily crunodal and the denier per filament of the protruding loops is generally the same as that of the base yarn and of larger denier than the present.

EXAMPLE IV

A 66 nylon yarn of 1260 denier, 210 filaments is overfed at 3.8 percent and combined with an effect yarn of 70 denier (78 dtex), 34 filaments 66 nylon overfed at 51 percent. The core/effect ratio is 93/7 and is therefore a very strong yarn, the effect overfeed being raised to near the upper limit of operability to provide sufficient surface loops to give spun-like aesthetics. This is about the maximum core/effect ratio for products of the invention.

EXAMPLE V

A core yarn of 840 denier (932 dtex), 140 filament, 66 nylon is overfed at 4.5 percent and joined with a 150 denier (165 dtex), 34 filament polyester effect yarn overfed at 35 percent. The core/effect ratio is 81/19.

EXAMPLE VI

The same core yarn and overfeeds as in Example V are used but one end of 150 denier (167 dtex) 68 filament polyester is used as the effect yarn. In the yarn of Example V the loops are fewer and extend further from the yarn bundle because there are half as many filaments and each filament is twice as large as the effect yarn of this Example.

The yarn of this Example is used in both warp and fill of a plain weave fabric 29×26 greige count. One portion of this fabric is dyed with 1.0 percent latyl blue BCN disperse dye and 1.0 grams per liter Liquid Carrier JT. The slightly different dyeing propensities of the nylon core and polyester effect yarns give a muted tone-on-tone heather appearance while the effect overfeed gives spunlike tactility. A second portion of this fabric is dyed with 0.5 percent Merpacyl ®Blue SW without carrier which dyes only the nylon core, leaving the polyester effect essentially white. This gives a novel heather appearance. The core/effect ratio of these yarns of 81/19 gives adequate tenacity for denim fabrics but is less desirable for industrial fabrics where maximum tenacity is required.

EXAMPLE VII

The same core yarn and overfeeds as in Examples V and VI are used, but in this case two ends of 150 denier (167 dtex), 68 filament polyester are used as the effect, giving a total effect denier of 300 (134 dtex) and 136 filaments. The core/effect ratio is 68/32. The effect yarns are well consolidated with the core. This yarn is significantly bulkier than the other yarns but has lower tenacity. Fabrics of this yarn would be suitable for upholstery.

What is claimed is:

1. A bulky continuous core and effect yarn comprising continuous filament core yarns substantially free from loops of polymeric material consisting of from 65 to 93 percent of the total filaments by weight and the remainder of the total filaments being continuous filament effect yarns having a denier per filament of up to 5.0 which are inserted between the filaments of the core yarn and protrude from the surface of the core yarn in a mixture of crunodal and arch-like loops and wherein the majority of effect yarn filament loops remain away from the surface of the core yarn for a distance less than 4.0 mm along the length of the core yarn.

2. The core and effect yarn of claim 1, said core yarn consisting of 90 percent of the total filaments by weight.

3. The core and effect yarn of claim 1, said core yarn consisting of 81 percent of the total filaments by weight.

4. The core and effect yarn of claim 1, said core yarn consisting of 68 percent of the total filaments by weight.

5. The core and effect yarn of claim 1, having a total breaking strength of from 80 percent to 90 percent of the breaking strength of the component core yarn.

6. The core and effect yarn of claim 1, wherein the core yarn has a tenacity of at least 5.5 grams per denier.

* * * * *